US005186110A

United States Patent [19]

Seitz

[11] Patent Number: 5,186,110

[45] Date of Patent: Feb. 16, 1993

[54] RAILROAD HOPPER CAR DISCHARGE GATE VALVE

[75] Inventor: Robert F. Seitz, Batavia, Ill.

[73] Assignee: Gen-Tech, Inc., North Aurora, Ill.

[21] Appl. No.: 881,349

[22] Filed: May 11, 1992

[51] Int. Cl.[5] ..... B65G 53/40

[52] U.S. Cl. ..... 105/247; 406/131

[58] Field of Search ..... 105/247, 239, 248, 280; 406/128, 129, 145, 130, 131, 193, 52, 62, 63, 68, 73, 74; 222/200, 554, 545, 555, 557, 556; 384/280, 281, 297, 290, 300, 295, 296, 903, 283, 909; 298/24, 26, 27

[56] References Cited

U.S. PATENT DOCUMENTS 3,797,891 3/1974 Fritz ..... 406/131
4,411,560 10/1983 McComb ..... 406/128
4,972,764 11/1990 Ohya et al. ..... 384/300
4,975,000 12/1990 Fritz et al. ..... 406/145
5,087,132 2/1992 Tanaka et al. ..... 384/909

*Primary Examiner*—Mark T. Le
*Attorney, Agent, or Firm*—Kinzer, Plyer, Dorn, McEachran & Jambor

[57] ABSTRACT

A discharge gate for a railroad hopper car has slope sheets terminating in longitudinally extending spaced lips. A through is secured to the slope sheets beneath the lips and a rotatable valve shaft controls the flow of material from the interior of the gate above the slope sheets to the discharge trough. The valve shaft has axially spaced and axially extending recessed areas and an intermediate full diameter portion between recesses. A spacer extends circumferentially about the shaft intermediate portion and radially outwardly therefrom. The spacer is in contact with the slope sheet lips and locates the shaft out of contact therewith.

4 Claims, 2 Drawing Sheets

RAILROAD HOPPER CAR DISCHARGE GATE VALVE

THE FIELD OF THE INVENTION

This invention relates to pneumatic hopper discharge outlets or gates for railway hopper cars which are used in transporting granular lading and has particular relation to the valve for the discharge gate. Prior art discharge gates of the type using a rotatable shaft as the discharge valve have required a center support to insure that the shaft does not contact the slope sheet lips. The use of a center support requires that the entire discharge gate be disassembled from the underside of the rail car for cleaning. The present invention provides a non-metallic spacer generally at the center of the valve shaft, with the spacer contacting the slope sheet lips to insure a uniform generally central position for the valve shaft even when an operator may exert a substantial weight on the valve operating handles which are positioned at opposite ends of the gate. Further, the elimination of the center support permits quick and easy disassembly and reassembly of the valve shaft for cleaning without the necessity of removing the entire discharge gate from the underside of the car.

THE PRIOR ART

U.S. Pat. Nos. 4,867,615, 4,973,067, 4,974,999, 4,975,000 and 5,005,739, all owned by the assignee of the present application, show discharge gates using a shaft as a discharge valve. U.S. Pat. Nos. 3,797,891 and 4,345,589 are also related to discharge gates of the general type disclosed herein.

SUMMARY OF THE INVENTION

The present invention relates to pneumatic discharge gates for railway hopper cars which are used to transport granular lading and has particular relation to providing a valve utilizing an elastomeric ring as a spacer for the valve shaft, thus eliminating the need for a center support.

A primary purpose of the invention is a discharge gate of the type described in which the longitudinally extending valve shaft has an intermediate spacer to insure uniform positioning of the valve shaft between the slope sheet lips, to eliminate any contact between the shaft and the slope sheets.

Another purpose is a valve of the type described which eliminates the potential of metal-to-metal contact between the valve shaft and slope sheet in any position of the shaft, thus avoiding the possibility of metal shavings contaminating the lading within the discharge gate, which can result in either rejection of the load or downgrading of the selling price or value of the material within the rail car.

Another purpose is a discharge gate of the type described which provides one or more elastomeric ring spacers to uniformly position and locate the valve shaft between the slop sheet lips.

Another purpose is a valve shaft for the use described which permits the discharge gate to be easily disassembled, cleaned, inspected and reassembled without having to drop the entire discharge gate from the rail car.

Another purpose is a discharge gate assembly as described which eliminates the need for a center bearing support to prevent metal-to-metal contact between the valve shaft and the slope sheet lips.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Railroad hopper cars carry various types of granular lading which may vary from small size chemical pellets to various agricultural commodities. It is absolutely necessary that the discharge gates of the car, as well as the compartments of the car, be thoroughly cleaned between trips so that there is no residue of material from the previous lading. Thus, it is important to provide discharge gates for the hopper car which not only are efficient and effective in discharging the rail car content or lading, but which also lend themselves to rapid and thorough cleaning.

A problem peculiar to those types of discharge gates which utilize a longitudinal extending valve shaft is that unless the shaft is properly centered in the discharge gate, there is the possibility of metal-to-metal contact between the shaft and the slope sheet lips which can result in minute metal shavings. Such shavings can contaminate the load, resulting either in a rejection of the load or a substantial loss in its value.

The present invention is particularly directed to a discharge gate utilizing a longitudinally extending valve shaft in which the valve shaft is centered between the slope sheet lips by an elastomeric spacer ring. The ring not only insures uniform location of the valve shaft between the slope sheet lips, avoiding metal-to-metal contact therebetween, but because this construction eliminates the center support common in such discharge gates, disassembly, cleaning, inspection and reassembly can be done without the necessity of removing the entire gate from the underside of the rail car.

Figure 1:
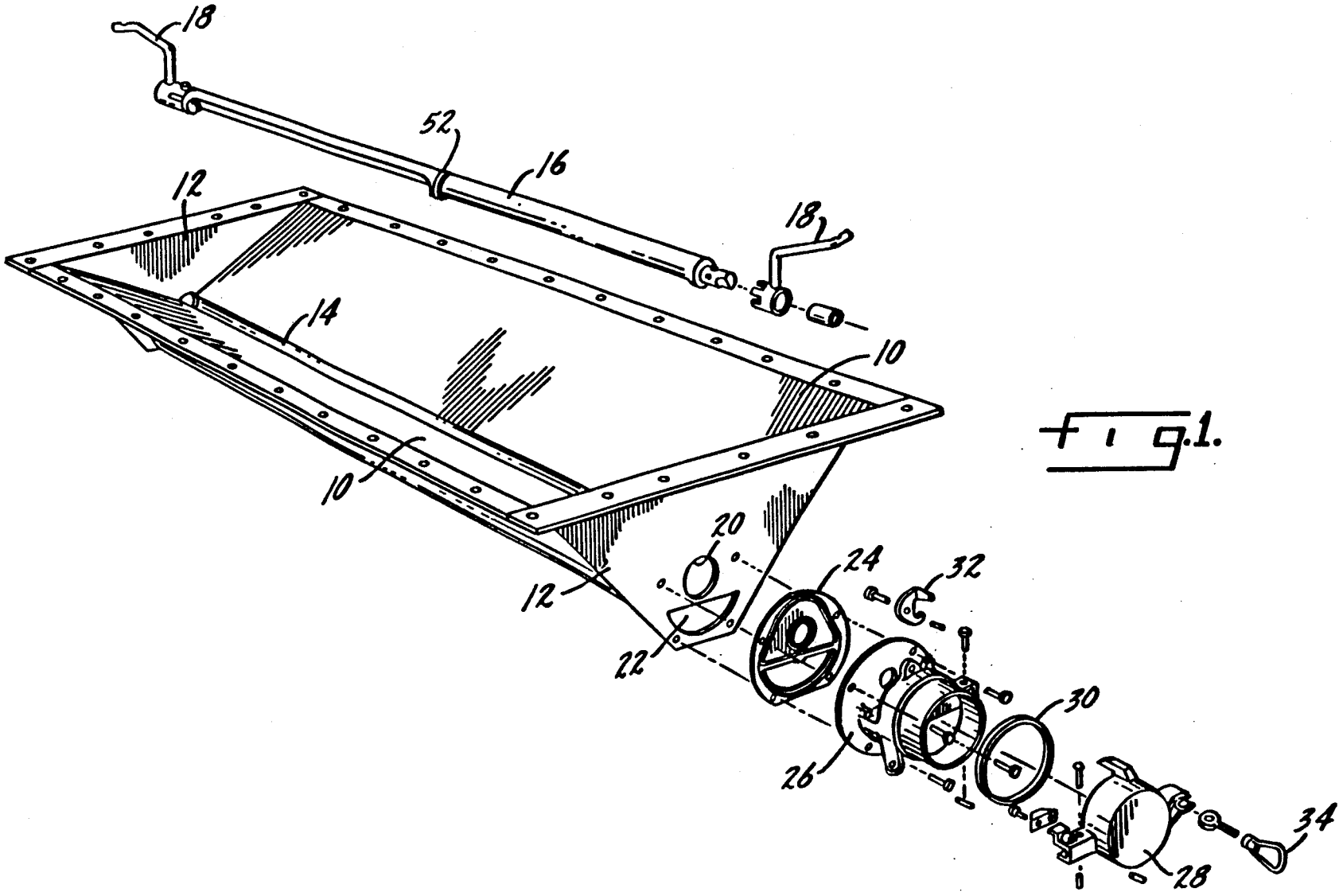
FIG. 1 is a perspective, in exploded form, illustrating the parts of the discharge gate of a railroad hopper car.
Figure 3:
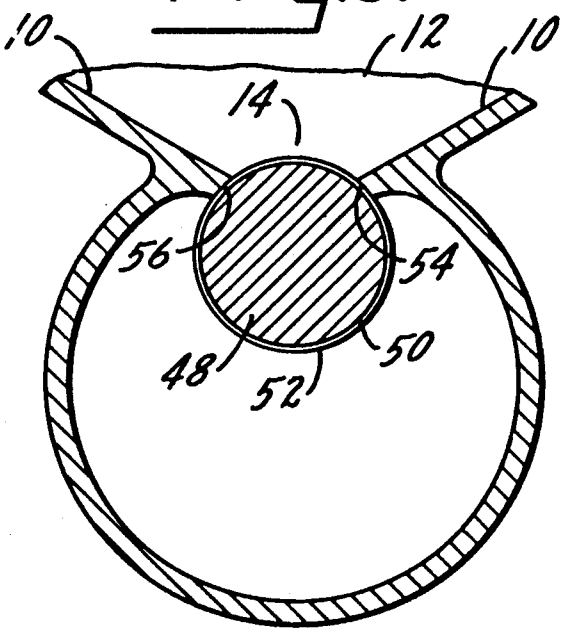
FIG. 3 is a partial vertical section through the discharge gate illustrating the slope sheet lips, the trough beneath the slope sheet, and the relationship of the valve shaft spacer to the slope sheet lips.

FIG. 1 illustrates the various parts of the outlet gate which form the discharge for a railroad hopper car. There will be several such gates in a conventional hopper car and the axis of the gates will be transverse to the longitudinal axis of the car. The gate includes slanted slope sheets 10 and end sheets or end plates 12 at opposite ends. There is a trough 14 which spans the space between the bottom edges or lips 54 and 56 of the slope sheets 10, as shown in FIG. 3. The outlet gate has an identical discharge at each end and includes a valve shaft 16 operable from either end by handles 18. The shaft 16 extends through a shaft opening 20. There is a discharge opening 22 in each end plate. The end tube seal is indicated at 24 and is in contact with the end plate and has openings which are in alignment with shaft opening 20 and discharge opening 22. Positioned adjacent the end tube seal is the end tube 26 which has a cap 28 mounted thereto and a cap seal 30. There are various other parts to the end tube structure, including a shaft lock 32 and an eyebolt 34 which is used in locking valve shaft 16 in any one of a number of predetermined positions.

As is known in the art, valve shaft 16 is rotatable between several fixed positions. There is a fully closed position, which is the position during travel; a fully open position, which requires manipulation of either of the handles located at the ends of the valve; and two partially open positions as well as a sample position. Normally, the fully open position is used by the operator to clean the gate after unloading.

Conventionally, it is necessary to turn shaft 16 with either of the handles located at each side of the gate to unload a car. In operating the handles it is not uncommon for the operating personnel to lean or push down on the handle which can cause a bend or bow in the valve shaft 16 causing it to come in contact with the slope sheet lips.

Figure 2:
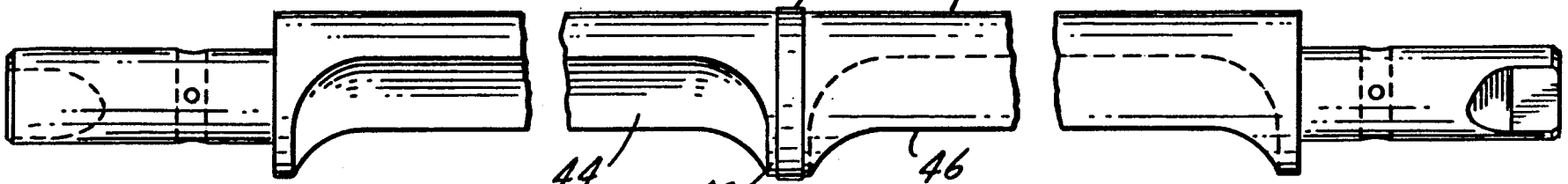
FIG. 2 is a side view of the discharge gate valve shaft.
Figure 5:
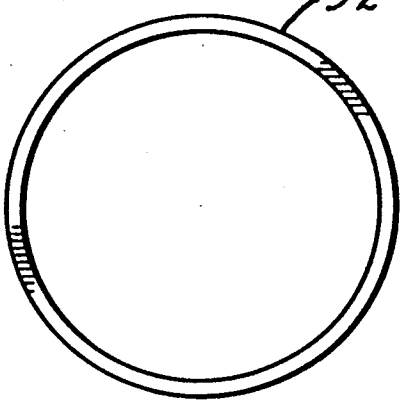
FIG. 5 is a plan view of the spacer.
Figure 4:
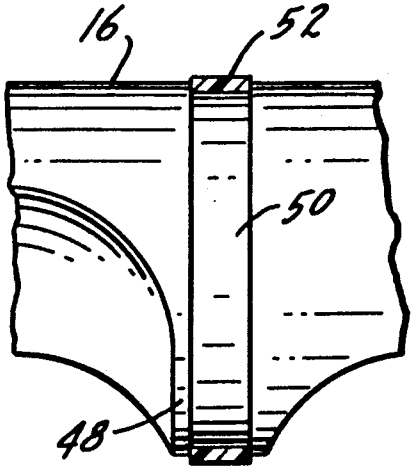
FIG. 4 is a side view of the valve shaft with a vertical section through the spacer.

As illustrated in FIG. 2, valve shaft 16 has two axially extending and axially spaced recessed areas or discharge channels 44 and 46. Combined, channels 44 and 46 extend generally the length of the shaft between the end plates. There is, however, between the recessed areas an unrecessed intermediate portion, which as shown herein is centrally located on the valve shaft, but which may be otherwise. Also, the invention has equal application in those instances in which there are multiple recesses and multiple areas of the shaft in which it has its full diametric form, with no recess. In any event, the intermediate portion, indicated at 48, has the full diameter of the shaft. This is shown particularly in FIGS. 2 and 4. There is a groove 50 formed in intermediate shaft portion 48 and positioned within groove 50 is an elastomeric spacer ring 52 which may be formed of various elastomeric materials. A urethane material having a 95A durometer is satisfactory. Ring 52 has an inner diameter less than the O.D. of shaft 16 and an outer diameter greater than the O.D. of the shaft 16 and the extent that ring 52 extends beyond the O.D. of the shaft may be on the order of about 1/32 inch.

There must be no contact between the slope sheet lips and the valve shaft as such metal-to-metal contact often results in contaminating metal shavings. The slope sheet lips will be contacted by the elastomeric ring and because of the low coefficient of friction of the ring material, the ring will rotate against the slope sheet lips with little friction. Because ring 52 only extends approximately 1/32 inch beyond the valve shaft, that is the size of the gap between the valve shaft and the slope sheet lips and thus there is little possibility of material loss through these openings. The ring provides a smooth bearing surface for shaft rotation, eliminates the very undesirable metal-to-metal contact potential between the shaft and the slope sheet lips and further permits the gate to be easily disassembled. In prior art constructions in which there is a center support for the valve shaft, which center support is generally fixed, for example by welding or the like, to the slope sheets, it is not possible to completely clean the gate without totally removing the gate from the underside of the rail car. In the present instance, the shaft may be removed once the end cap structures have been taken off of either end of the gate. There is no need to totally remove the gate from the underside of the car for cleaning.

Whereas the preferred form of the invention has been shown and described herein, it should be realized that there may be many modifications, substitutions and alterations thereto.

The embodiments of the invention in which an exclusive property are claimed are defined as follows:

1. A discharge gate for a railroad hopper car including slope sheets, each terminating in a longitudinally extending lip, said lips being spaced, and a trough secured to the slope sheets beneath the space between the lips, a rotatable longitudinal discharge valve shaft extending between the spaced lips of the slope sheets and positioned to control flow of material from the gate interior above the slope sheets to the discharge trough, operating handle means mounted to said gate for rotating said shaft, said shaft having axially spaced and axially extending recessed areas, said recessed-areas being circumferentially non-aligned, but in part circumferentially overlapping, said shaft having an intermediate portion, between axially extending recesses, an elastomeric spacer extending circumferentially about said shaft intermediate portion and radially outwardly therefrom, said spacer being in contact with said slope sheet lips and uniformly locating said valve shaft between said lips and out of contact therewith.

2. The discharge gate of claim 1 further characterized in that said spacer is generally centrally positioned on said valve shaft.

3. The discharge gate of claim 1 further characterized by and including a circumferential groove positioned in said intermediate portion, said spacer being positioned within said groove and extending outwardly therefrom.

4. The discharge gate of claim 3 further characterized in that said spacer has an inner diameter less than the outer diameter of said shaft intermediate portion and an outer diameter greater than the diameter of said shaft intermediate portion.

* * * * *